US006186657B1

(12) United States Patent
Fuchsbichler

(10) Patent No.: US 6,186,657 B1
(45) Date of Patent: Feb. 13, 2001

(54) APPARATUS AND METHOD FOR MIXING PARTICULATE SOLIDS OR GELS IN A LIQUID

(76) Inventor: Kevin Johan Fuchsbichler, "Melrose", Belka South Road, Bruce Rock, W.A. 6418 (AU)

( * ) Notice: Under 35 U.S.C. 154(b), the term of this patent shall be extended for 0 days.

(21) Appl. No.: 09/194,154

(22) PCT Filed: May 30, 1997

(86) PCT No.: PCT/AU97/00347

§ 371 Date: Mar. 31, 1998

§ 102(e) Date: Mar. 31, 1998

(87) PCT Pub. No.: WO97/46307

PCT Pub. Date: Dec. 11, 1997

(30) Foreign Application Priority Data

May 31, 1996 (AU) ..... PO0220

(51) Int. Cl.[7] ..... B01F 5/04; B01F 15/02

(52) U.S. Cl. ..... 366/165.4; 366/165.5; 366/173.2; 366/191

(58) Field of Search ..... 366/136, 137, 366/163.1, 163.2, 165.1, 165.4, 165.5, 167.1, 173.1, 173.2, 181.6, 182.3, 182.4, 191; 137/888, 889, 890, 892–894

(56) References Cited

U.S. PATENT DOCUMENTS 626,950 * 6/1899 Wheelwright .
1,160,848 * 11/1915 Conklin ..... 366/163.2
2,795,403 * 6/1957 Mead ..... 366/163.2
2,906,607 * 9/1959 Jamison .
2,997,373 * 8/1961 Stephens .
3,547,410 * 12/1970 Van Der Windt et al. ..... 366/163.2
4,100,614 * 7/1978 Mandt ..... 366/163.2
4,447,157 * 5/1984 Underwood ..... 366/137
4,863,277 * 9/1989 Neal et al. ..... 366/137
5,344,619 * 9/1994 Larwick et al. ..... 366/163.2
5,609,417 * 3/1997 Otte ..... 366/173.2
6,065,860 * 5/2000 Fuchsbichler .
6,109,778 * 8/2000 Wilmer .

FOREIGN PATENT DOCUMENTS

2031748 * 4/1980 (GB) .
4-141226 * 5/1992 (JP) ..... 366/163.2
95/03120 * 2/1995 (WO) ..... 366/137

* cited by examiner

*Primary Examiner*—Charles E. Cooley
(74) *Attorney, Agent, or Firm*—Pollock, Vande Sande & Amernick, R.L.L.P.

(57) ABSTRACT

An apparatus and method for mixing or dissolving a particulate solid or gel in a liquid to form a solution of substantially homogeneous concentration. The apparatus includes a vessel which has a cylindrical portion integral with a large diameter end of a frustoconical portion. The vessel has a series of liquid inlets, located in a wall of the cylindrical portion and frustoconical portion, and a solution outlet formed at a small diameter end of the frustoconical portion. An elbow-shaped nozzle is connected to each of the liquid inlets, the nozzles directing liquid flow parallel to the inside surface of the vessel. The apparatus also includes a venturi adjacent the outlet in order to create a low pressure zone downstream of the venturi to suck or draw liquid or solution from the vessel.

6 Claims, 1 Drawing Sheet

APPARATUS AND METHOD FOR MIXING PARTICULATE SOLIDS OR GELS IN A LIQUID

FIELD OF THE INVENTION

The present invention relates generally to an apparatus and method for mixing or dissolving a particulate solid or gel in a liquid to form a solution of a homogeneous concentration.

BACKGROUND TO THE INVENTION

Australian Patent No. 665,513 describes a vessel including a conical base used for mixing or dissolving a granular chemical in water. The vessel incorporates several elbow-shaped nozzles designed to direct the flow of water around the internal periphery of the vessel. The nozzles in combination with the conical base of the vessel create a circular flow of water in the vessel which is effective for dissolving the granular chemical. The water and granular chemical are recirculated through the vessel via a pump to promote dissolution of the granular chemical. Once the granular chemical is dissolved in the water, it is pumped to a boom spray tank or the like.

Where aggressive or corrosive chemicals are to be dissolved, the pump and valving must be constructed from materials which are compatible with these chemicals. For example, seals used in the pump and valve may need to be made of a suitable polymeric material, such as a VITON® material. Furthermore, the wetted internal parts of the pump and valves may need to be lined or constructed of a corrosion-resistant material, such as Type 316 stainless steel.

When used for mixing or dissolving particularly aggressive chemicals, even where the pump and valving are made of appropriate materials, frequent maintenance and replacement of parts is necessary. Pumps and valves constructed from compatible and corrosion-resistant materials are also generally expensive.

SUMMARY OF THE INVENTION

It is an object of the present invention to provide an apparatus and method for mixing or dissolving a particulate solid or gel in a liquid, the apparatus and method being suited to a variety of applications in effectively forming a solution of a homogeneous concentration.

According to a first aspect of the present invention, there is provided an apparatus for mixing or dissolving a particulate solid or a gel in a liquid to form a solution of a homogeneous concentration. The apparatus comprises:

- a vessel designed to contain the liquid or the solution, the vessel including an outlet; and
- a venturi coupled to the vessel adjacent the outlet, an upstream side of the venturi operatively coupled to and in fluid communication with a pump and a downstream side of the venturi located adjacent the outlet so that, in use, a flow of fluid from the pump and through the venturi creates a relatively low pressure zone adjacent the outlet and thus sucks liquid or solution from the vessel, creating a vortex of liquid or solution in the vessel, this vortex being effective in mixing or dissolving the particulate solid or gel in the liquid to form the solution of a substantially homogeneous concentration.

Preferably, the vessel includes a cylindrical portion formed integral with a large diameter end of a frusoconical portion having the outlet located at a small diameter end thereof.

Typically, the pump is designed to couple to a supply of the liquid used to mix with or dissolve the particulate solid or gel, the liquid thereby acting as the fluid passing through the venturi and effecting suction of the liquid or solution from the vessel. In this embodiment, the vessel includes one or more inlets each operatively coupled to and in fluid communication with the pump, so that a portion of the flow of liquid from the supply can be diverted to the vessel via one or more inlets, and the remainder of the flow of liquid can pass through the venturi, thereby driving the vortex of liquid or solution in the vessel and thus mixing or dissolving the particulate solid or gel in the liquid. In one such example, the apparatus includes a vessel inlet valve positioned between one or more inlets and the pump, the vessel inlet valve being designed to control the passage of the diverted portion of the flow of liquid to the vessel.

Typically, the supply of the liquid is a "fresh" water supply. Alternatively, the supply of the liquid is a portion of the solution of a substantially homogeneous concentration, the portion being recirculated through the venturi and/or the vessel via the pump.

Preferably, the apparatus for mixing or dissolving further comprises static means connected to the vessel, the static means being designed to direct the diverted portion of the flow of liquid in a direction substantially parallel to an inside surface of the vessel adjacent the inlet, thereby promoting the vortex. Typically, the static means comprises a nozzle connected to each of one or more vessel inlets, the nozzle being configured to direct the diverted portion of the flow of liquid in a direction substantially parallel to the inside surface of the vessel adjacent the respective inlets. In one example, the nozzle is an elbow-shaped tube connected to the inside surface of the frustoconical portion of the vessel.

Typically, the venturi comprises a pipe having a reduced-diameter section defining a throat, the relatively low-pressure zone being located adjacent a downstream side of the throat.

Typically, the apparatus for mixing or dissolving further comprises a venturi valve located on an upstream side of the venturi, the venturi valve being designed to control the flow of fluid through the venturi and thus the suction of liquid or solution from the vessel. More typically, the apparatus also comprises a vessel outlet valve located adjacent the vessel outlet, the vessel outlet valve being used to control the suction of liquid or solution from the vessel. Advantageously, the venturi valve and the vessel inlet valve can be adjusted to vary the concentration of particulate solid or gel in the solution.

According to a second aspect of the present invention, there is provided a method for mixing or dissolving a particulate solid or a gel in a liquid to form a solution of a homogeneous concentration, the method comprising the steps of:

- at least partly filling a vessel with the liquid, the vessel having a cylindrical portion formed continuous with a large diameter end of a conical frustum including an outlet at a small diameter end thereof; and
- flowing fluid through a venturi located adjacent the outlet and thus sucking the liquid or solution from the vessel via the outlet, whereby a vortex of liquid or solution is created in the vessel, the vortex being effective in mixing or dissolving the particulate solid or gel in the liquid to form the solution of a substantially homogeneous concentration.

Typically, the step of flowing fluid through a venturi involves diverting a portion of the liquid used to fill the vessel through the venturi, wherein said liquid portion acts as the fluid which drives the venturi, thereby effecting the vortex of liquid or solution in the vessel and thus mixing or dissolving the particulate solid or gel in the liquid.

Typically, the step of at least partly filling the vessel with the liquid involves directing the liquid in a direction substantially parallel to an inside surface of the vessel, so that the vortex of liquid or solution in the vessel is promoted.

Preferably, the method further comprises the step of controlling the flow of liquid both through the venturi and to the vessel, so that the concentration of particulate solid or gel in the solution can be varied.

BRIEF DESCRIPTION OF THE DRAWINGS

In order to achieve a better understanding of the nature of the present invention, a preferred embodiment of an apparatus and method for mixing or dissolving a particulate solid or a gel in a liquid will now be described, by way of example only, with reference to the accompanying drawings.

DETAILED DESCRIPTION OF THE PREFERRED EMBODIMENT

Figure 1:
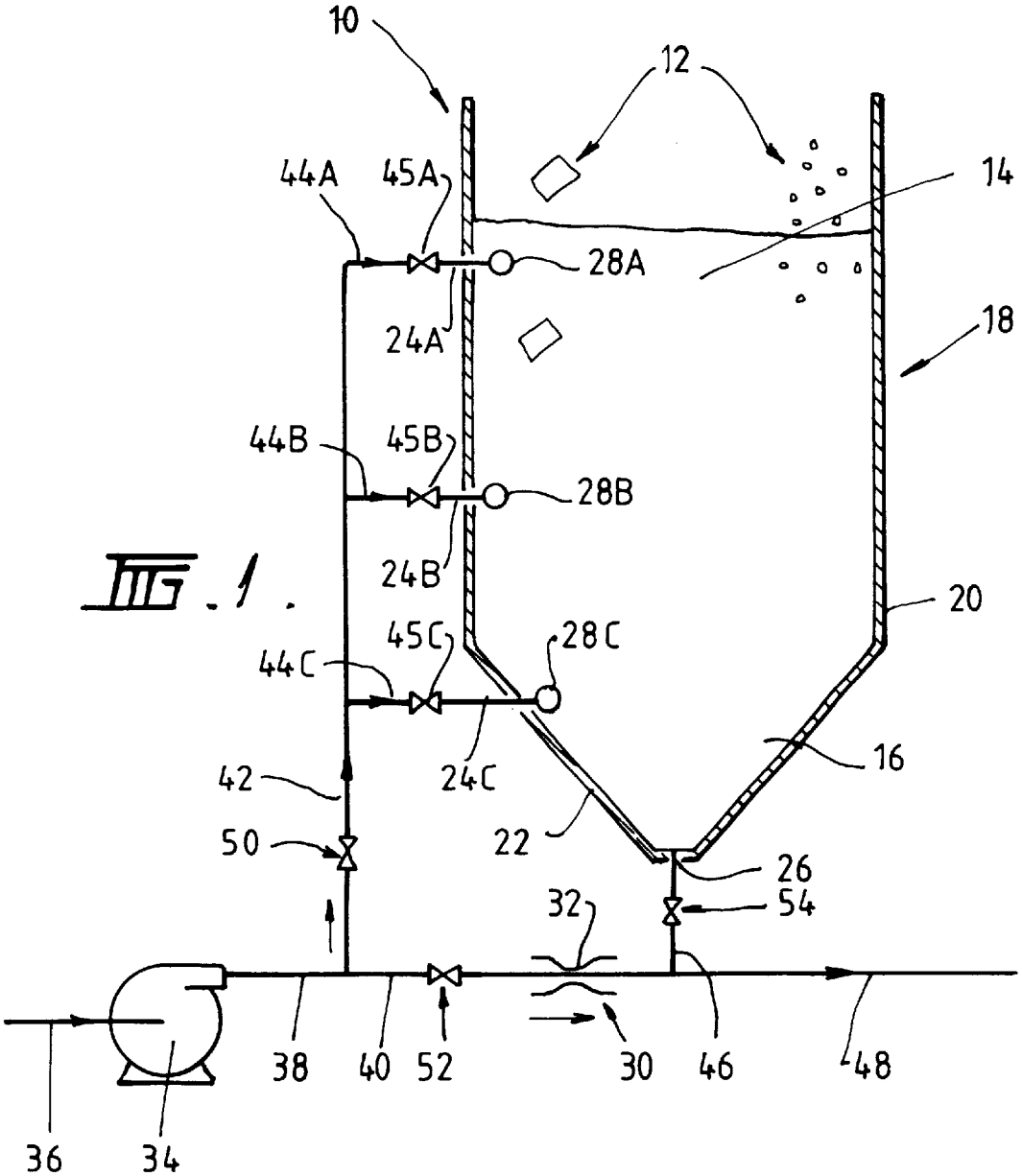
FIG. 1 is a front elevation view of an apparatus for mixing or dissolving a particulate solid or gel in a liquid to form a solution of a substantially homogeneous concentration.
Figure 2:
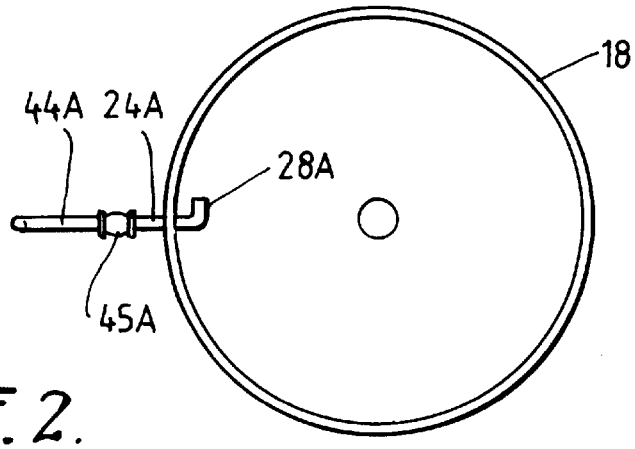
FIG. 2 is a schematic top plan view of the apparatus.

The apparatus 10 comprises a vessel 18 having a cylindrical portion 20 formed integral with a large diameter end of a frustoconical portion 22. The vessel 18 includes a series of liquid inlets 24A, 24B, 24C and a solution outlet 26. The liquid inlets 24A, 24B, 24C are located in a wall of the cylindrical portion 20 and frustoconical portion 22 of the vessel 18. The solution outlet 26 is formed at a small diameter end of the frustoconical portion 22. An elbow-shaped nozzle 28A, 28B, 28C is connected to each of the liquid inlets 24A, 24B, 24C, respectively, the nozzles 28A; 28B, 28C being designed to direct a flow of liquid parallel to an inside surface of the vessel 18.

The apparatus 10 further comprises a venturi 30, shown schematically, coupled to the vessel 18 adjacent the outlet 26. The venturi 30 is of conventional construction, having a reduced diameter section 32 defining a throat. Fluid, in this instance liquid, flowing through the venturi 30 creates a low pressure zone downstream of the venturi 30 and thus sucks or draws liquid 14 or solution 16 from the vessel 18.

The apparatus 10 also includes a pump 34 operatively coupled to a liquid supply, in this example a water supply (not shown), the pump 34 being used to deliver water both into the vessel 18 and through the venturi 30. In one example, the water supply is a "fresh" water supply. In an alternative example, the water supply consists of a portion of the solution 16, this portion being taken from downstream of the venturi 30 and recirculated through the venturi 30 and/or the vessel 18 via the pump 34.

The pump 34 and venturi 30 are plumbed to the vessel 18 as illustrated in FIG. 1. A pump feed line 36 draws water from the water supply, and a pump discharge line 38 delivers water to both the vessel 18 and the venturi 30. The pump discharge line 38 splits into a venturi line 40 and a vessel inlet line 42 coupled to the venturi 30 and the vessel inlets 24A, 24B, 24C, respectively. The vessel inlet line 42 has three branched lines 44A, 44B and 44C connected to the flow nozzles 28A, 28B, 28C, respectively. A nozzle flow control valve 45A to 45C is plumbed to each of the branched lines 44A to 44C, respectively, so as to allow for control of water flowing to each of the nozzles 28A to 28C.

A vessel outlet line 46 connects the vessel outlet 26 to the venturi line 40 immediately downstream of the venturi 30. Finally, a boomspray tank feed line 48 connects to the vessel outlet line 46 and the venturi line 40 downstream of the venturi 30.

An inlet valve 50 is included on the vessel inlet line 42 to control the flow of water to the vessel 18. A venturi valve 52 is located on the venturi line 40 upstream of the venturi 30. The venturi valve 52 controls the flow of water through the venturi 30 and thus the suction of water 14 or solution 16 from the vessel 18. This can also be controlled by a vessel outlet valve 54 located on the vessel outlet line 46 adjacent the outlet 26.

In order to facilitate a further understanding of the present invention, the operation of the mixing or dissolving apparatus 10 described above, will now be explained in some detail.

In this example, the apparatus 10 is used to dissolve a gel or granular chemical 12 in water 14 to produce a solution 16 of a substantially homogeneous concentration. However, it will be appreciated that the invention also extends to other gels, particulate solids, and liquids to be mixed or dissolved.

To initially fill the vessel 18 with water, the venturi valve 52 and the vessel outlet valve 54 are closed and the vessel inlet valve 50 opened so that water is pumped into the vessel 18 via the vessel inlet line 42. Once the water 14 has reached a suitable level in the vessel 18, the vessel outlet valve 54 and the venturi valve 52 are at least partly opened. The flow of water through the venturi 30 sucks water 14 or solution 16 from the vessel 18 through the outlet 26. The water or solution is discharged to a boomspray tank (not shown) via the boomspray tank line 48.

The vessel 18 having a frustoconical portion 22 in combination with the flow nozzles 28A, 28D, 28C creates a vortex of water 14 or solution 16 in the vessel 18 as solution 16 is drawn from the base of the vessel 18. The vortex of water 14 or solution 16 is effective in mixing or dissolving particulate solid or gel 12, which is added to the water 14. Thus, a solution 16 having a substantially homogeneous concentration is sucked from the vessel 18 via the action of the venturi 30. Significantly, the solution 16, which in some instances may contain particularly aggressive or corrosive substances, does not contact the pump 34.

Furthermore, undissolved granular chemicals 12 remain adjacent the surface of the liquid or solution 14 in the vessel 18 until they are dissolved. This is believed to be due largely to the centrifugal force exerted on the granular chemicals 12 as a result of the vortex created in the vessel 18. Where gels contained in water-soluble bags are used, this centrifugal force acts to burst the bag and then dissolve the bag before it leaves the vessel. Therefore, in both of these applications, undissolved granular chemicals or gel-bags do not flow from the vessel, and this minimizes the risk of blocking downstream equipment.

The vessel inlet valve 50, the venturi valve 52, and the vessel outlet valve 54 may be adjusted to vary the concentration of particulate solid or gel 12 in the solution 16. For example, by further opening both the vessel inlet valve 50 and the venturi valve 52, the volume of water 14 and solution 16 passing through the vessel 18 is increased and the concentration of particulate solid or gel in the solution 16 thereby decreased. However, it will be appreciated that generally a constant level of solution 16 in the vessel 18 should be maintained by controlling the vessel inlet valve 50, the venturi valve 52, and the vessel outlet valve 54.

Now that a preferred example of the invention has been described in some detail, it will be apparent to those of ordinary skill in the relevant arts that the apparatus and method described have at least the following advantages over the admitted prior art:

(1) the apparatus and method are suited to a variety of applications, particularly where aggressive or corrosive substances are involved;

(2) continuous or semi-batch mixing or dissolving of particulate solids or gels in liquids to effectively form a solution of a homogeneous concentration may be achieved;

(3) the apparatus and method are relatively safe and efficient in mixing or dissolving a particulate solid or a gel in a liquid; and (4) particulate solids or water-soluble bags containing gels do not leave the vessel until they are dissolved, thus minimizing the risk of blocking downstream equipment.

It will also be apparent to those of ordinary skill in the relevant arts that numerous variations and modifications can be made to the invention in addition to those already described above without departing from the scope of the present invention. For example, a separate fluid may be used to drive the venturi rather than using the liquid which is used to mix or dissolve a particulate solid or a gel, as described hereinabove. The invention may rely solely on the vessel having an outlet and the effect of gravity to create a vortex of liquid or solution in the vessel. That is, it is not essential that the invention include either an elbow-shaped nozzle or the like, or a cylindrical vessel which together promote the vortex in the vessel.

The claims defining the invention are as follows:

1. An apparatus for dissolving a particulate solid or a gel in a liquid to form a solution of homogeneous concentration, said apparatus including (a) a vessel for containing the liquid or solution, said vessel having an upper cylindrical portion and a lower co-axial frustum portion having a large diameter end proximal to said cylindrical portion and an outlet coaxial with a small diameter end of said frustum portion;

(b) a pump having a feed line coupled to a supply of liquid for dissolving said solid or gel, and a discharge line branching into a vessel line to divert a portion of said liquid to said vessel and a venturi line to direct a remaining portion of said liquid to a venturi having an upstream end in fluid communication with said venturi line and a downstream end in fluid communication with said outlet;

(c) a plurality of inlets providing fluid communication between said vessel line and said vessel, with one inlet provided in said frustum portion and at least one inlet in said cylindrical portion;

(d) a plurality of nozzles, one of each being provided at an end of each inlet inside said vessel, each nozzle being configured to direct the diverted portion of liquid to flow in a circular path substantially parallel to an inside surface of the vessel adjacent the inlet; and (e) an apparatus discharge line in fluid communication with said downstream end of said venturi and said outlet, the venturi creating a low pressure zone adjacent said outlet to suck liquid or solution from said vessel to flow through the apparatus discharge line, and which flow, together with the substantially parallel flow of the diverted portion of liquid, produces a vortex of liquid or solution within said vessel to dissolve said particulate solid or gel, and creates a centrifugal force that holds undissolved particulate solid or gel adjacent said inside surface of said vessel until dissolved.

2. The apparatus according to claim 1, wherein each said nozzle is in the form of an elbow shaped tube and disposed to direct the diverted portion of liquid to flow in a direction substantially parallel to said inside surface of said vessel.

3. The apparatus according to claim 2, further comprising a venturi valve located in the venturi line upstream of said venturi to allow control of the flow of fluid through said venturi.

4. The apparatus according to claim 3, further including a vessel inlet valve located in an upstream end of said vessel line for controlling the flow of diverted liquid into said vessel line.

5. The apparatus according to claim 4, further including a plurality of nozzle flow control valves, one of each said nozzle valves being in fluid communication with and disposed between respective ones of said plurality of inlets and said vessel line.

6. A method for dissolving a particulate solid or a gel in a liquid to form a solution of substantially homogeneous concentration, said method comprising the steps of:

(a) providing a vessel for containing the liquid or solution, said vessel having an upper cylindrical portion and a lower co-axial frustum portion having a large diameter end proximal to said cylindrical portion and an outlet formed co-axial with a small diameter end of said frustum portion for discharge of said liquid or solution from said vessel;

(b) diverting a portion of liquid from a supply of liquid for dissolving said particulate solid or gel to a plurality of nozzles attached to said vessel, one nozzle being attached to said frustum portion and at least one nozzle being attached to said cylindrical portion;

(c) disposing said nozzles for directing the diverted liquid parallel to an inside surface of said vessel adjacent the respective nozzles to produce a circular flow of said liquid;

(d) coupling an upstream end of a venturi with a venturi line through which a remaining portion of the liquid from the supply flows, and coupling the downstream end of said venturi to said outlet; and (e) directing liquid from the supply to flow through said nozzles and through said venturi line and thus through said venturi, so that said venturi creates a suction to draw the liquid or solution from said outlet of said vessel, the combined action of the circular flow produced by said nozzles and the drawing of liquid produced by said venturi creating a vortex flow of liquid and a centrifugal force that holds any dissolved particles or gel adjacent the inside surface of said vessel to substantially fully dissolve said particulate solid or gel prior to flowing through said outlet to form a solution of substantially homogenous concentration.

* * * * *